US006655398B2

(12) United States Patent
Huang

(10) Patent No.: US 6,655,398 B2
(45) Date of Patent: Dec. 2, 2003

(54) UMBRELLA HAVING A RESILIENT WHALE BONE DEVICE

(76) Inventor: Lu Tsai Huang, 7F, No. 46, Pin Ho 10 Street, Chang Hua (TW), 500

( * ) Notice: Subject to any disclaimer, the term of this patent is extended or adjusted under 35 U.S.C. 154(b) by 42 days.

(21) Appl. No.: 09/992,424

(22) Filed: Nov. 26, 2001

(65) Prior Publication Data

US 2003/0098049 A1 May 29, 2003

(51) Int. Cl.[7] ..... A45B 25/00
(52) U.S. Cl. ..... 135/29; 135/25.3; 135/31
(58) Field of Search ..... 135/25.3, 25.31, 135/25.32, 25.34, 26, 29, 31, 37

(56) References Cited

U.S. PATENT DOCUMENTS 5,193,565 A * 3/1993 Huang ..... 135/25.3
5,337,770 A * 8/1994 Wang ..... 135/25.3
5,467,792 A * 11/1995 Okuda ..... 135/25.3
5,494,065 A * 2/1996 Kuo et al. ..... 135/31
5,975,099 A 11/1999 Johnson et al.
6,095,170 A * 8/2000 Wang ..... 135/31
6,227,216 B1 * 5/2001 Dweck ..... 135/15.1
6,332,472 B1 * 12/2001 Kuo ..... 135/29

FOREIGN PATENT DOCUMENTS

| | | | | |
|---|---|---|---|---|
| DE | 3809873 | * | 10/1989 | ..... 135/25.3 |
| EP | 230494 | * | 8/1987 | ..... 135/25.3 |
| GB | 2250681 | * | 6/1992 | ..... 135/25.31 |

* cited by examiner

*Primary Examiner*—Lanna Mai
*Assistant Examiner*—Hanh V. Tran

(57) ABSTRACT

An umbrella includes a number of strut assemblies each having a beam and a spring rod pivotally coupled between a strut and a rib. The spring rod includes a middle portion slidably coupled to the beam. A pole is slidably secured to the beam and coupled to the middle portion of the spring rod. For example, the pole includes an aperture for receiving the middle portion of the spring rod and for allowing the middle portion of the spring rod to be loosely coupled to the beam and for preventing the spring rod from being bent or damaged by the beam.

7 Claims, 6 Drawing Sheets

UMBRELLA HAVING A RESILIENT WHALE BONE DEVICE

BACKGROUND OF THE INVENTION

1. Field of the Invention

The present invention relates to an umbrella, and more particularly to an umbrella having a resilient whale bone device.

2. Description of the Prior Art

Typical whale bone devices for umbrellas comprise a telescoping post including a stationary hub disposed and provided on top thereof, a handle secured or attached to the bottom thereof, and comprise a whale bone device attached to the upper portion of the telescoping post. The whale bone device includes a number of strut assemblies connected to the stationary hub and each having a number of struts pivotally secured together and openable to an open and working position, and foldable to a compact folding structure. U.S. Pat. No. 5,975,099 to Johnson et al. discloses one of the typical umbrellas. However, the struts may be moved relative to each other, such that the whale bone device or the strut assemblies have no spring biasing members or devices disposed between the struts for applying a resilient biasing force against the struts of the strut assemblies, and for opening or for folding the struts to the compact folding structure.

The present invention has arisen to mitigate and/or obviate the afore-described disadvantages of the conventional whale bone devices for umbrellas.

SUMMARY OF THE INVENTION

The primary objective of the present invention is to provide an umbrella including a resilient whale bone device having a resilient member for applying a spring biasing force against the struts of the strut assemblies, and for opening or for folding the struts to the compact folding structure.

The other objective of the present invention is to provide an umbrella including a strut assembly having a beam and a spring rod movably coupled to the beam for preventing the spring rod from being firmly secured to the beam and for preventing the spring rod from being bent or damaged by the beam.

In accordance with one aspect of the invention, there is provided an umbrella comprising a whale bone device including a plurality of strut assemblies, the strut assemblies each including a strut including a first end and a second end, a beam including a first end pivotally secured to the second end of the strut, and including a second end, a rib including a first end pivotally secured to the second end of the beam, a spring rod including a first end attached to the strut, and including a second end attached to the rib, and including a middle portion, and means for movably coupling the middle portion of the spring rod to the beam.

The strut includes a catch attached thereon, and coupled to the first end of the spring rod, and includes a hole formed therein, the catch includes two legs engaged into the hole of the strut for securing the catch to the strut.

The rib includes an arm extended from the first end thereof and pivotally secured to the second end of the spring rod.

The movably coupling means includes a pole slidably secured to the beam and coupled to the middle portion of the spring rod. The pole includes an aperture formed therein for receiving the middle portion of the spring rod.

The beam includes an orifice formed therein for slidably receiving the pole therein. The beam includes an opening communicating with the orifice thereof and having a diameter greater than that of the orifice of the beam, the movably coupling means includes a block slidably secured in the opening of the beam and having the pole extended therefrom.

The umbrella includes a telescoping post, and a stationary hub secured on top of the post and pivotally secured to the first end of the strut, the strut includes a middle portion, a ring is slidably engaged on the post, a stay includes a first end pivotally secured to the ring and a second end pivotally secured to the middle portion of the strut, the beam includes an extension extended from the first end thereof, and a lever pivotally coupled between the extension of the beam and the stay.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
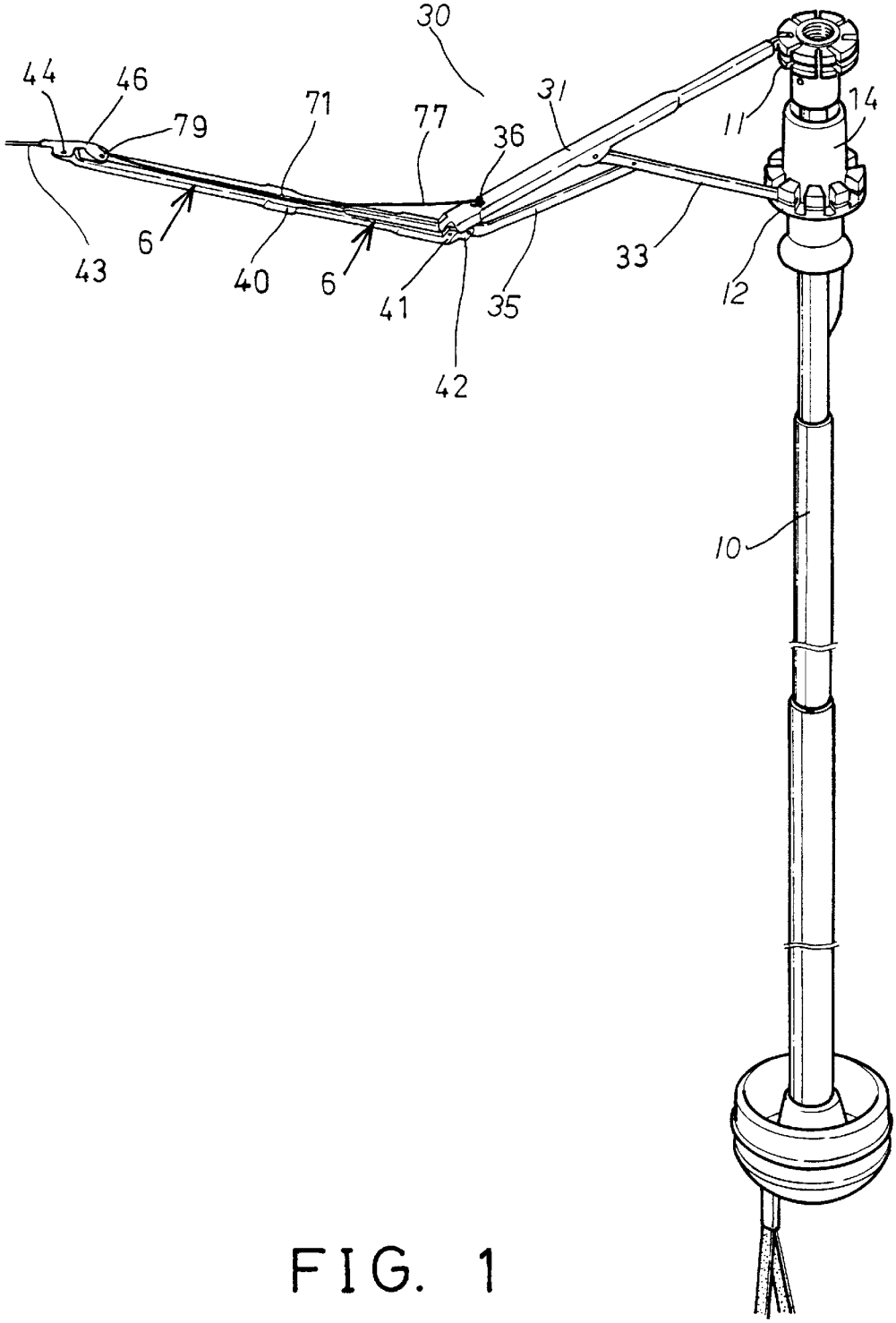
FIG. 1 is a partial perspective view of an umbrella having a whale bone device in accordance with the present invention.
Figure 2:
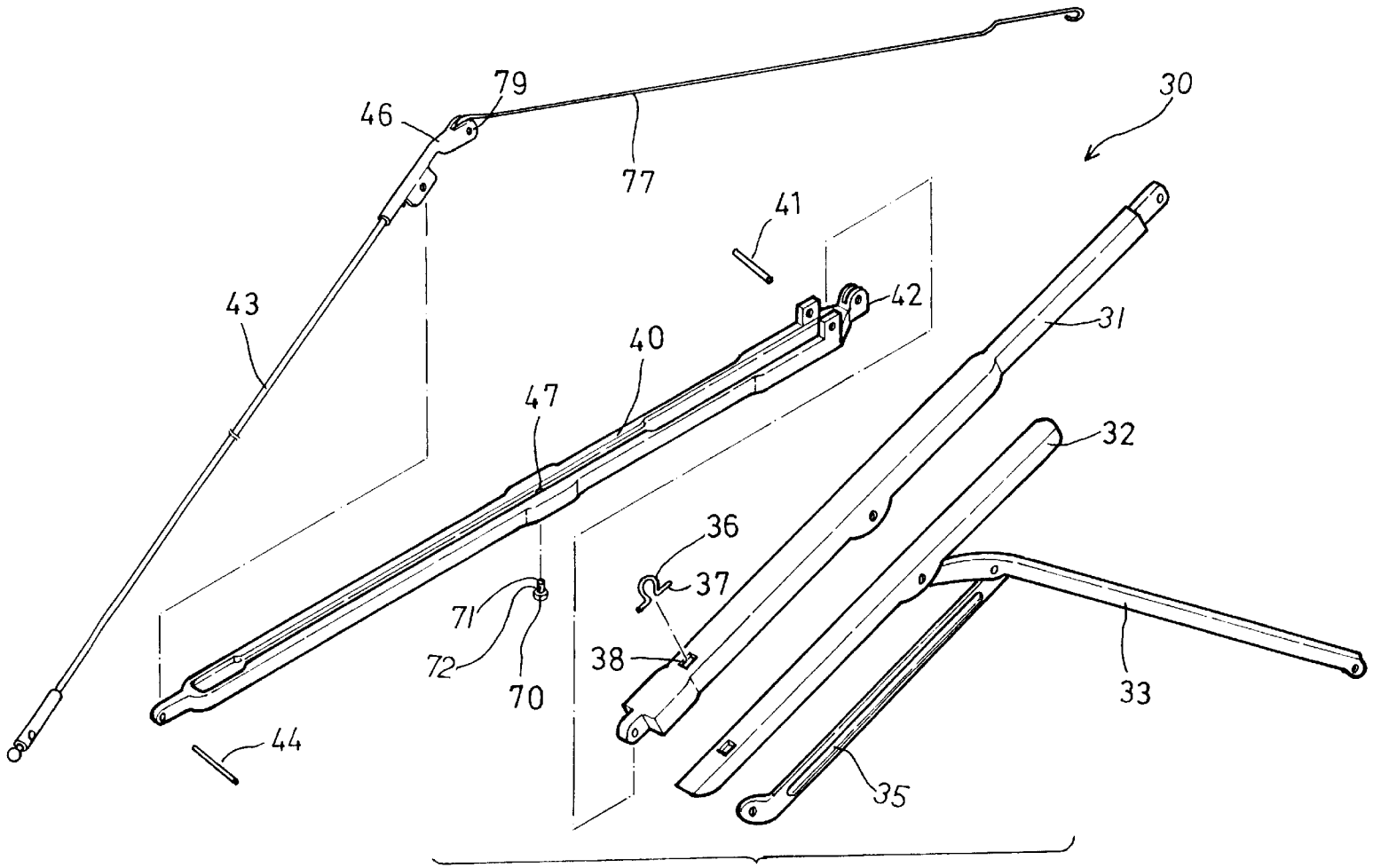
FIG. 2 is a partial exploded view of the whale bone device for the umbrella.
Figure 3:
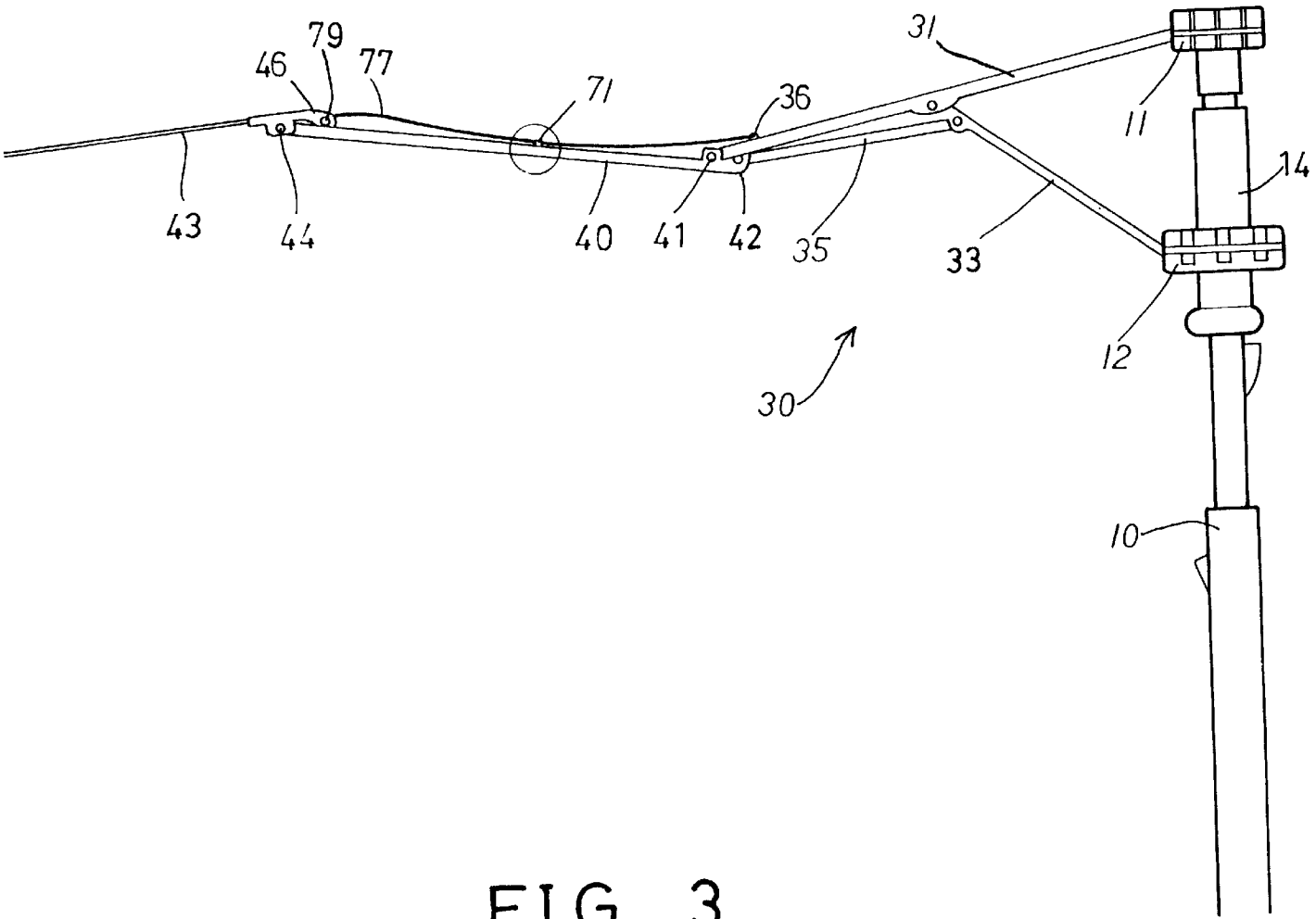
FIG. 3 is a plan schematic view of the whale bone device for the umbrella.

Referring to the drawings, and initially to FIGS. 1–3, an umbrella in accordance with the present invention comprises a telescoping post 10 including a stationary hub 11 disposed and provided on top thereof, and a barrel 14 slidably attached onto the post 10 and movable up and down relative or along the post 10. The barrel 14 includes a ring 12 secured or attached thereon. The umbrella comprises a whale bone device attached to the upper portion of the telescoping post 10, and including a number of strut assemblies 30 arranged around the stationary hub 11 and connected to the stationary hub 11 and the ring 12 of the barrel 14. As shown in FIGS. 1–5, for clear illustrating purposes, only one of the strut assemblies 30 is shown in the drawing figures. The strut assemblies 30 each includes a number of struts or beams or ribs pivotally secured together and openable to an open and working position, and foldable to a compact folding structure.

For example, as best shown in FIGS. 1–3, the strut assemblies 30 of the whale bone device each includes a strut 31 having one end rotatably or pivotally secured to the stationary hub 11, a beam 40 having one end rotatably or pivotally secured to the other end of the strut 31 with a pivot pin 41, and a rib 43 having one end rotatably or pivotally secured to the other end of the beam 40 with a pivot axle 44. The strut 31 may be made of plastic materials, composite materials, or the like, and includes a reinforcing bars 32 of such as metal materials engaged and secured therein for reinforcing purposes. A stay 33 has one end rotatably or pivotally secured to the ring 12 and the other end rotatably or pivotally secured to the middle portion of the strut 31.

Figure 4:
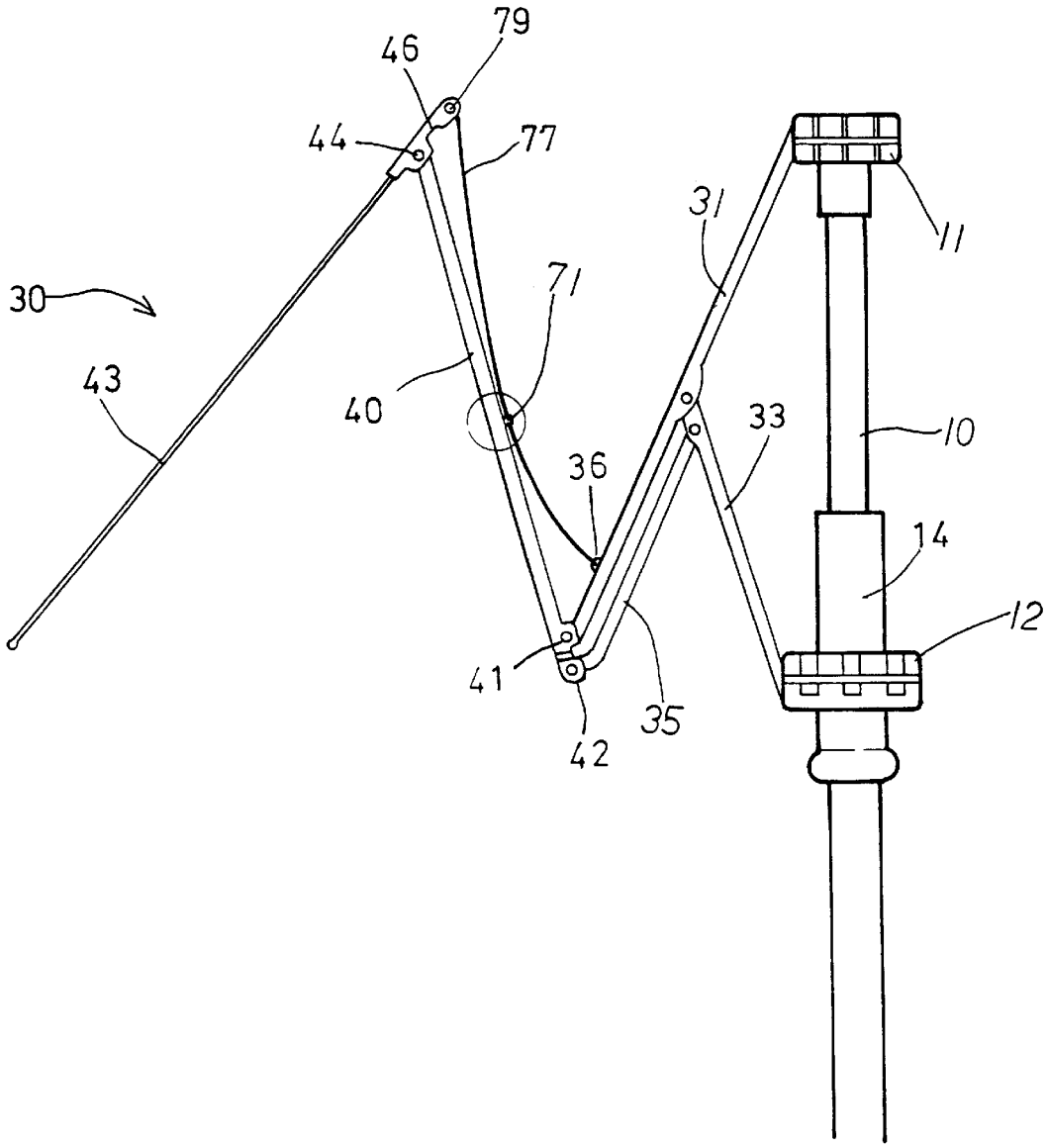
FIGS. 4, 5 are plan schematic views similar to FIG. 3, illustrating the operation of the whale bone device for the umbrella.
Figure 5:
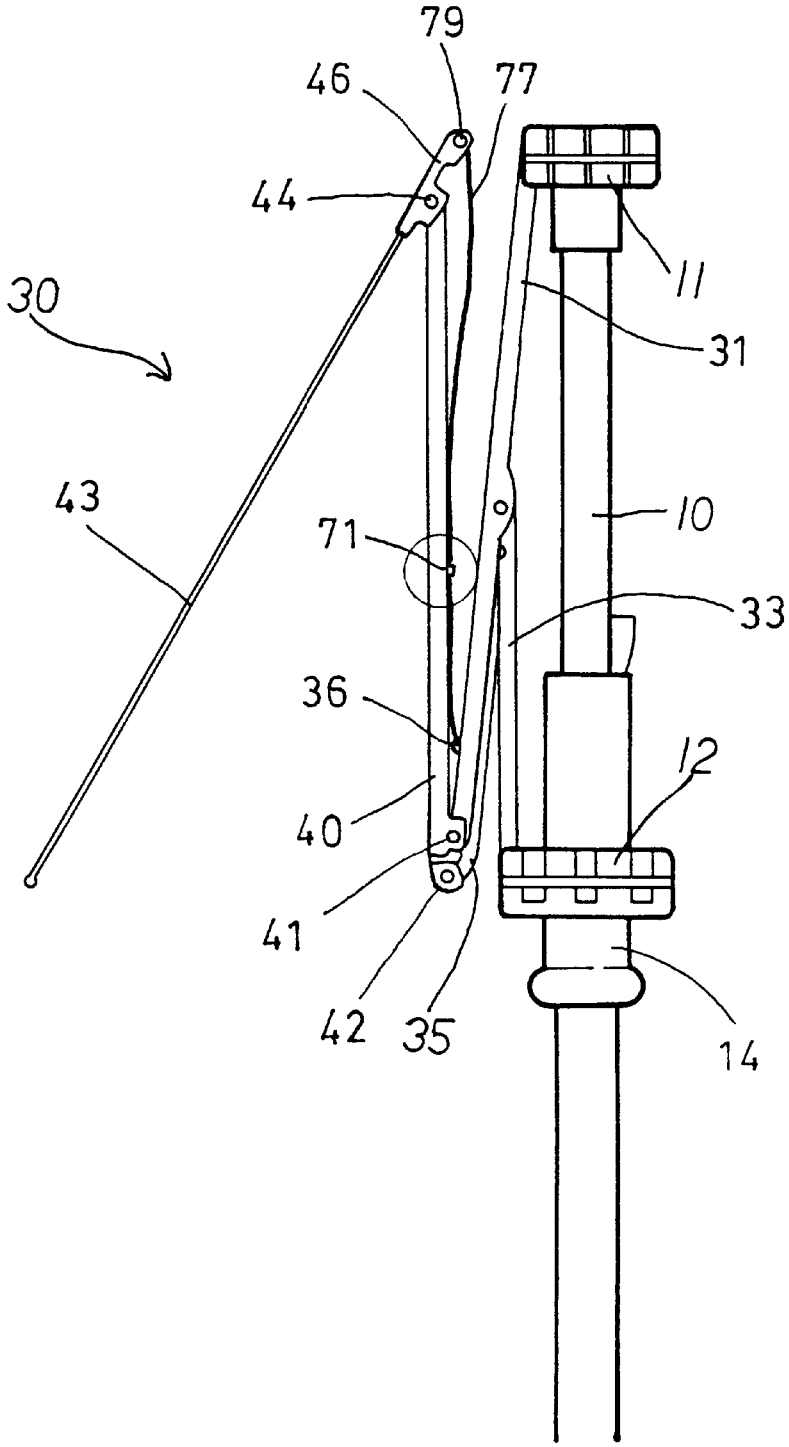
Figure 7:
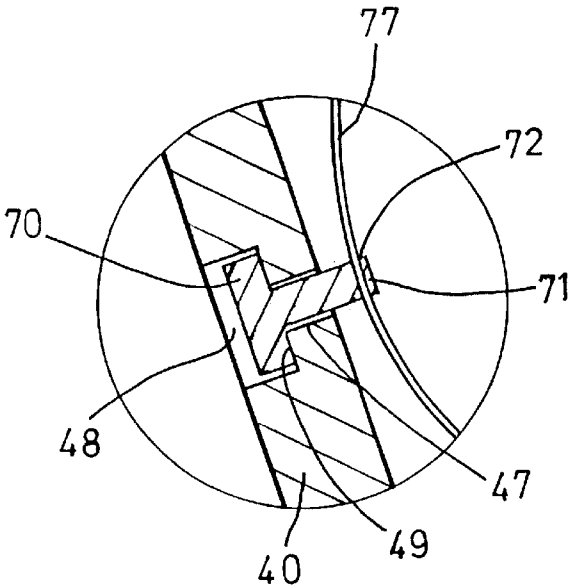
FIGS. 6, 7, 8 are enlarged partial cross sectional views illustrating the operation of the spring biasing member for the whale bone device of the umbrella.
Figure 8:
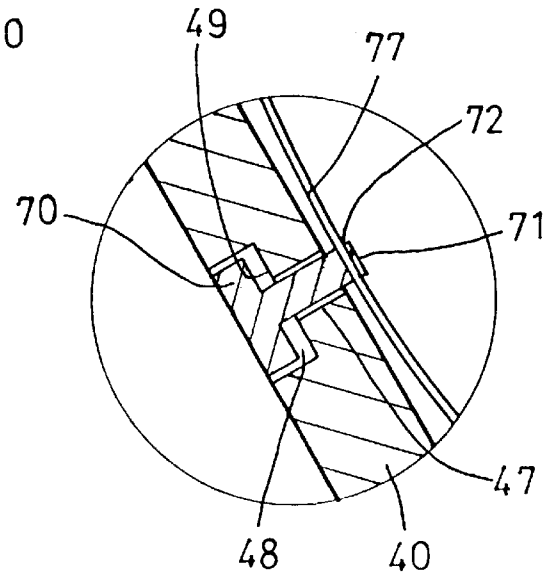
Figure 6:
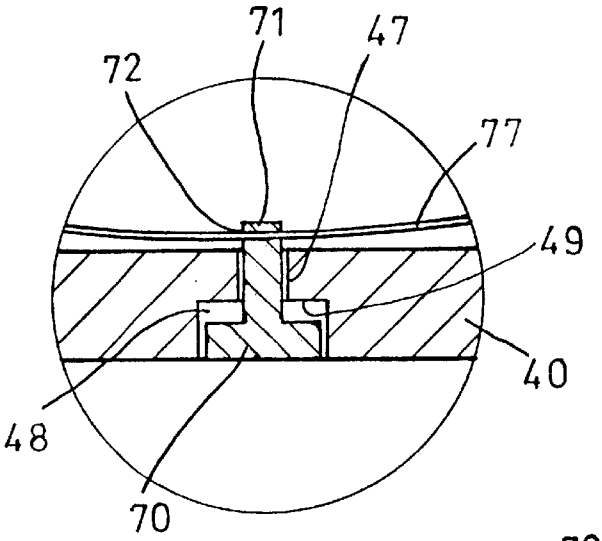

The beam 40 includes an extension 42 extended from the one end thereof or extended outward beyond the pivot pin 41 and rotatably or pivotally secured to the stay 33 with a lever 35. The lever 35 is substantially parallel to the strut 31 for extending the beam 40 outward to the open position as shown in FIGS. 1, 3 when the ring 12 moves the one end of the stay 33 upward toward the stationary hub 11, and for folding the beam 40 inward toward the close position as shown in FIGS. 4, 5 when the ring 12 moves the one end of the stay 33 downward away from the stationary hub 11. The rib 43 includes an arm 46 extended from the one end thereof or extended outward beyond the pivot axle 44. The above-described configuration is typical and will not be described in further details.

As best shown in FIGS. 2 and 6–8, the beam 40 includes an orifice 47 and an opening 48 formed in the middle portion thereof, and communicating with each other, and having different inner diameters for forming a shoulder 49 therebetween. A block 70 is slidably engaged in the opening 48 of the beam 40, and includes a pole 71 extended therefrom and having a smaller diameter than that of the block 70 for slidably engaging in the orifice 47 of the beam 40. The pole 71 includes an aperture 72 formed therein and extendible outward of the beam 40.

The strut 31 includes a hole 38 formed in the other end portion thereof (FIG. 2). A loop or a hook or a catch 36 has two legs 37 engaged into the hole 38 of the strut 31 for attaching or securing the catch 36 to the strut 31. The catch 36 is slightly spaced away from or located close to the pivot pin 41. A resilient or spring member or a spring blade or a spring rod 77 has a middle portion engaged through the aperture 72 of the pole 71, and includes one end secured or hooked to the catch 36, and the other end rotatably or pivotally secured to the arm 46 of the rib 43 with a pivot shaft 79. The spring member 77 may apply a resilient or biasing force against the strut assembly 30 for facilitating the opening or the closing of the strut assembly 30 between the open and working position and the compact folding structure.

It is to be noted that the pole 71 and the block 70 may be slided relative to the beam 40, such that the middle portion of the spring rod 77 will not be firmly secured and may be slightly moved relative to the beam 40, and such that the middle portion of the spring rod 77 will not be bent or damaged by the pole 71. The middle portion of the spring rod 77 may also be slidably or adjustably or movably attached to the middle portion of the beam 40 by the other similar devices (not shown), such as the hooks, the loops, the rings, or the like.

Accordingly, the umbrella in accordance with the present invention includes a resilient whale bone device having a resilient member for applying a spring biasing force against the struts of the strut assemblies, and for opening or for folding the struts to the compact folding structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An umbrella comprising:

a whale bone device including a plurality of strut assemblies, said strut assemblies each including:

a) a strut including a first end and a second end, b) a beam including a first end pivotally secured to said second end of said strut, and including a second end, and including an orifice formed therein, c) a rib including a first end pivotally secured to said second end of said beam, d) a spring rod including a first end attached to said strut, and including a second end attached to said rib, and including a middle portion, and e) means for movably coupling said middle portion of said spring rod to said beam, said movably coupling means including a pole slidably received in said orifice of said beam and coupled to said middle portion of said spring rod.

2. The umbrella according to claim 1, wherein said strut includes a catch attached thereon, and coupled to said first end of said spring rod.

3. The umbrella according to claim 2, wherein said strut includes a hole formed therein, said catch includes two legs engaged into said hole of said strut for securing said catch to said strut.

4. The umbrella according to claim 1, wherein said rib includes an arm extended from said first end thereof and pivotally secured to said second end of said spring rod.

5. The umbrella according to claim 1, wherein said pole includes an aperture formed therein for receiving said middle portion of said spring rod.

6. The umbrella according to claim 1, wherein said beam includes an opening communicating with said orifice thereof and having a diameter greater than that of said orifice of said beam, said movably coupling means includes a block slidably secured in said opening of said beam and having said pole extended therefrom.

7. The umbrella according to claim 1 further comprising a telescoping post, a stationary hub secured on top of said post and pivotally secured to said first end of said strut, said strut including a middle portion, a ring slidably engaged on said post, a stay including a first end pivotally secured to said ring and a second end pivotally secured to said middle portion of said strut, said beam including an extension extended from said first end thereof, and a lever pivotally coupled between said extension of said beam and said stay.

* * * * *